US011078750B2

(12) United States Patent
Giroux

(10) Patent No.: US 11,078,750 B2
(45) Date of Patent: Aug. 3, 2021

(54) PLUG SYSTEM

(71) Applicant: Weatherford Technology Holdings, LLC, Houston, TX (US)

(72) Inventor: Richard Lee Giroux, Bellville, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/109,459

(22) Filed: Aug. 22, 2018

(65) Prior Publication Data

US 2020/0063524 A1 Feb. 27, 2020

(51) Int. Cl.

| | |
|---|---|
| ***E21B 33/14*** | (2006.01) |
| ***E21B 33/124*** | (2006.01) |
| ***E21B 33/126*** | (2006.01) |
| ***E21B 34/06*** | (2006.01) |

(52) U.S. Cl.

CPC ..... *E21B 33/14* (2013.01); *E21B 33/124* (2013.01); *E21B 33/126* (2013.01); *E21B 34/063* (2013.01); *E21B 2200/06* (2020.05)

(58) Field of Classification Search

CPC ..... E21B 33/12

See application file for complete search history.

(56) References Cited

U.S. PATENT DOCUMENTS

| | | | | |
|---|---|---|---|---|
| 4,047,566 | A * | 9/1977 | Duke | E21B 33/05 166/285 |
| 5,443,122 | A | 8/1995 | Brisco | |
| 5,553,667 | A | 9/1996 | Budde et al. | |
| 5,556,667 | A | 9/1996 | Teranishi et al. | |
| 5,813,457 | A | 9/1998 | Giroux et al. | |
| 5,890,537 | A | 4/1999 | Lavaure et al. | |
| 5,950,725 | A | 9/1999 | Rondeau et al. | |
| 6,009,944 | A | 1/2000 | Gudmestad | |
| 6,082,451 | A | 7/2000 | Giroux et al. | |
| 6,206,094 | B1 | 3/2001 | Smith, Jr. | |
| 6,244,350 | B1 | 6/2001 | Gudmestad et al. | |
| 6,309,002 | B1 | 10/2001 | Bouligny | |
| 6,311,771 | B1 | 11/2001 | Gudmestad et al. | |
| 6,419,015 | B1 | 7/2002 | Budde et al. | |
| 6,799,638 | B2 | 10/2004 | Butterfield, Jr. | |
| 7,325,610 | B2 * | 2/2008 | Giroux | E21B 7/20 166/177.4 |
| 8,316,931 | B2 | 11/2012 | Rondeau et al. | |
| 8,327,930 | B2 | 12/2012 | Rondeau | |
| 8,327,937 | B2 | 12/2012 | Giem et al. | |
| 8,789,582 | B2 | 7/2014 | Rondeau et al. | |
| 9,200,499 | B2 | 12/2015 | Hall et al. | |
| 2005/0103492 | A1 | 5/2005 | Szarka | |
| 2010/0294503 | A1 | 11/2010 | Laurel et al. | |
| 2015/0101801 | A1 | 4/2015 | Budde | |

FOREIGN PATENT DOCUMENTS

| | | | |
|---|---|---|---|
| WO | 1994027026 | A1 | 11/1994 |

* cited by examiner

*Primary Examiner* — William D Hutton, Jr.
*Assistant Examiner* — Avi T Skaist
(74) *Attorney, Agent, or Firm* — Patterson + Sheridan, LLP

(57) ABSTRACT

A system for cementing a tubular within a wellbore includes a connector; a tubular housing attached to the connector and disposed in the tubular; and a plug disposed in the tubular housing and releasably attached to the tubular housing.

20 Claims, 6 Drawing Sheets

PLUG SYSTEM

BACKGROUND

Field

Embodiments of the present disclosure generally relate to a system and method of performing a cementing operation. More particularly, the present disclosure relates to a releasable plug system for cementing a casing in a wellbore.

Description of the Related Art

A wellbore is formed by using a drill bit on a drill string to drill through a geological formation. After drilling through the formation to a predetermined length or depth, the drill string and drill bit are removed, and the wellbore is lined with a string of casing. The space between the outer diameter of the casing and the wellbore is referred to as an annulus. In order to prevent the casing from moving within the wellbore, the annulus is filled with cement using a cementing operation. In addition to preventing the casing from moving within the wellbore, the cemented annulus also provides for a stronger wellbore for facilitation of hydrocarbon production.

When the casing is sent downhole, the casing is typically filled with a fluid, such as drilling mud, and the fluid is maintained at a predetermined pressure. The fluid within the casing ensures that the casing does not collapse within the wellbore. A bottom end of the casing usually includes a float assembly, such as a float collar or a float shoe. The float assembly includes one or more unidirectional check valves that allow fluid to pass from the casing out to the annulus, but prevents fluid from entering from the annulus into the casing. An upper end of the float assembly may also include a receptacle for receiving a device, such as a cement plug.

During a cementing operation, it is preferred that the cement is isolated or separated from any other fluid within the casing. When fluids such as drilling mud mix with cement, it can cause the cement to sour and fail when it sets. Accordingly, a first plug is usually sent down in front of the cement during a cementing operation. The first plug includes one or more fins around its circumference which acts to separate the drilling fluid below the first plug from the cement above the first plug. The fins also clean the inner walls of the casing as the first plug descends into the casing. Because the first plug provides both a separation and cleaning function, the outer diameter of the first plug is approximately equal to the inner diameter of the casing. The first plug includes a bore through a center longitudinal portion of the first plug. The first plug also includes a rupture membrane, such as rupture disk, radially positioned across the bore, which prevents the drilling fluid below the first plug from comingling with the cement above the first plug. As the first plug descends into the casing, the drilling fluid moves through the float assembly and out into the annulus. The check valve within the float assembly prevents the drilling fluid from moving back into the casing.

Once the first plug reaches the float assembly, hydrostatic pressure builds on the upper side of the rupture membrane. Once the first plug reaches a rupture pressure, the rupture membrane ruptures, and the cement flows through the bore of the first plug, through the float assembly, and into the annulus. The check valve within the float assembly prevents the cement from moving back into the casing.

A second plug is usually sent down the casing behind the cement, and the second plug is usually pushed downward with drilling fluid. The second plug includes one or more fins that separate the cement below the second plug from the drilling fluid above the second plug. The fins also clean the sidewalls of the casing as the second plug descends down the casing. The second plug generally does not include a bore within a center portion. As the second plug is pushed through the casing, the cement is squeezed out of the float assembly into the annulus until the second plug reaches the first plug. In some embodiments, the first plug and second plug are locked together. In the prior art, at least one of the first or second plugs form a seal within the casing, which prevents fluid from moving past the first or second plugs. Once the wellbore is sealed, the cement is given time to cure and set up as a constant pressure is maintained within the casing. Before or after the cement has cured, the casing is pressure tested by injecting additional drilling fluid into the casing up to a casing operational pressure, which is then held for a certain time period in order to establish the back pressure capabilities of the casing.

In some instances, the plugs are held in position using collets. Darts are dropped into wellbore to sequentially release the plugs. The collets are typically made of aluminum. After the cementing operation, the aluminum collets are drilled out from the wellbore.

Therefore, there is a need for an improved releasable plug system and a method of removing the plugs after a cementing operation.

SUMMARY

In one embodiment, a system for cementing a tubular within a wellbore includes a connector; a tubular housing attached to the connector and disposed in the tubular; and a plug disposed in the tubular housing and releasably attached to the tubular housing.

A method of cementing a tubular in a wellbore includes coupling a plug system to the tubular, wherein the plug system includes a connector coupled to the tubular; a tubular housing attached to the connector and at least partially disposed in the tubular; and a first plug disposed in the tubular housing and releasably attached to the tubular housing. The method also includes releasing the first plug from the tubular housing; opening a port in the first plug; and flowing cement through the port.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
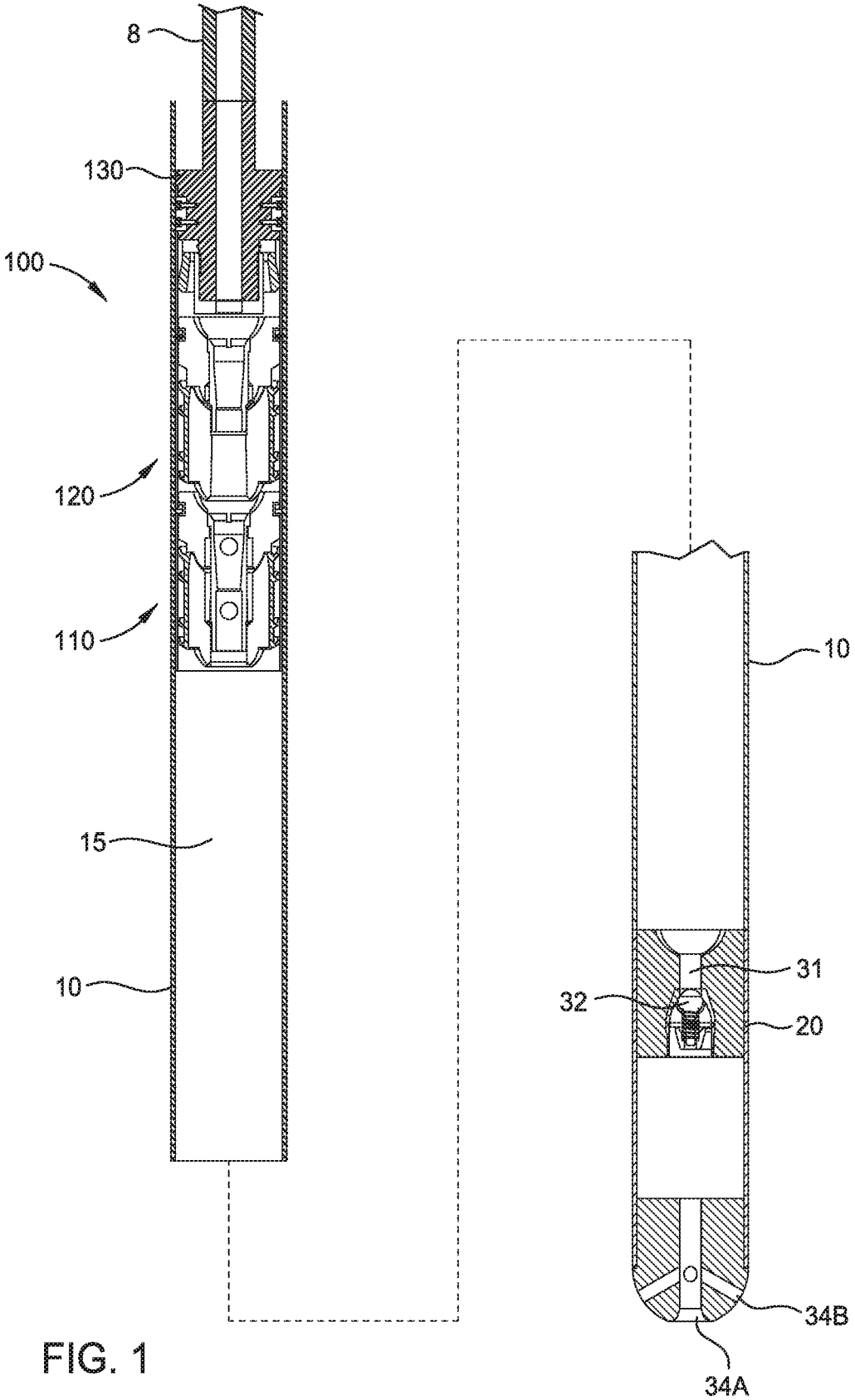
FIG. 1 illustrates an exemplary system for a cementing operation

FIG. 1 illustrates an embodiment of a system for a cementing operation. A casing 10 has been lowered into a wellbore and includes a collar assembly such as a float assembly 20 disposed at a lower end of the casing 10. The float assembly 20 includes a bore 31 and may include one or more valves 32 for controlling fluid flow through the bore 31. In one embodiment, the valve 32 is a one way valve configured to allow fluid to flow through the bore 31 and out of the casing 10, but prevent fluid re-entering the casing 10 through the bore 31. The fluid may flow out of the casing 10 through one or more ports 34A, 34B at the bottom of the casing 10. In another embodiment, the collar assembly may be a landing collar, which may include a bore without a valve.

Figure 2:
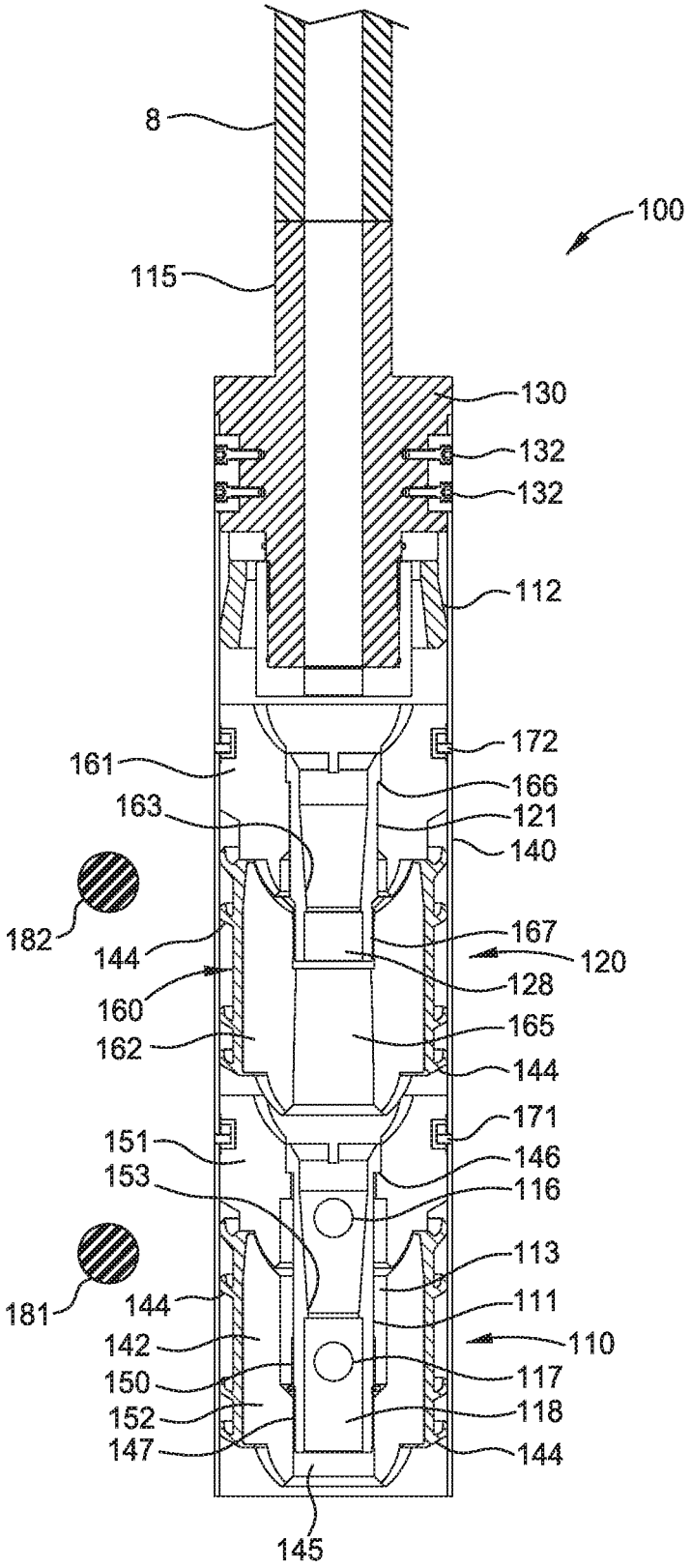
FIG. 2 illustrates an enlarged view of a plug assembly.

The casing 10 is releasably attached to a plug assembly 100, according to one embodiment. FIG. 2 illustrates an enlarged view of a plug assembly 100. The plug assembly 100 includes a connector 130, a tubular housing 140, a first plug 110, and a second plug 120. An upper end of the connector 130 may be attached to a conveyance string 8 such as a drill pipe string. The tubular housing 140 is attached to the connector 130. A portion of the connector 130 is at least partially disposed in the tubular housing 140. The tubular housing 140 may be attached using a plurality of screws 132. The tubular housing 140 can be made of steel, metal alloy, or other suitable material. The tubular housing 140 may be between 3 feet and 40 feet in length or between 3 feet and 20 feet in length. The connector 130 includes a bore 115 in fluid communication with the conveyance string 8 and the bore 15 of the tubular housing 140. A sealing member 112 such as a cup seal is attached to the connector 130 and used to prevent fluid communication in an annular area between the connector 130 and the housing 140 and to prevent communication of plug launch pressure to the exterior of housing 140 via holes (not shown) located above the cup seal. In one embodiment, the tubular housing 140 is made of steel, aluminum, or other suitable metal or metal alloy. In another embodiment, the tubular housing 140 is retrievable to surface and re-used.

The first plug 110 and the second plug 120 are disposed in the housing 140 and releasably attached to the housing 140. The first plug 110 is disposed below the second plug 120, and the second plug 120 is disposed below the connector 130. In this embodiment, neither plug 110, 120 is attached to the connector 130. In this arrangement, the first plug 110 may be referred to as the bottom plug and the second plug 120 may be referred to as the top plug. It is contemplated the plug system may include two or more plugs to separate various fluids, such as spacer fluids, different types of cement, used in the cementing operation.

The first plug 110 and the second plug 120 are used to separate the cement from fluid in front of the cement and the fluid behind the cement. The fluid in front may be a drilling fluid and the fluid behind may be a push fluid such as a drilling fluid. In some applications, a spacer fluid may be disposed between the cement and the fluid in front of the cement, disposed between the cement and the push fluid behind the cement, or both.

In one embodiment, the first plug 110 includes a plug body 142 having a bore 145 extending through the plug body 142. A first seat sleeve 111 is disposed in the bore 145 of the first plug 110. The first seat sleeve 111 includes a sleeve bore 118 formed therethrough. The first seat sleeve 111 can be made of a drillable material, such as fiberglass, aluminum, metal alloy, plastic, and combinations thereof. An annular area 113 is formed between the first seat sleeve 111 and the wall of the bore 145. The first seat sleeve 111 includes one or more upper ports 116 for fluid communication between the sleeve bore 118 and the annular area 113. For example, one, two, or four ports 116 can be circumferentially spaced around the first seat sleeve 111. The first seat sleeve 111 also includes one or more lower ports 117 for fluid communication between the sleeve bore 118 and the annular area 113. For example, one, two, or four ports 117 can be circumferentially spaced around the first seat sleeve 111. In one embodiment, a rupture sleeve 150 is disposed around the lower ports 117 to block fluid communication through the lower ports 117. The rupture sleeve 150 is rupturable at a predetermined pressure to open the lower ports 117 for fluid communication. Other suitable shearable members, such as a rupture disk attached to each lower port 117, may be used to selectively block fluid communication through the lower ports 117. A sealing seat 153 is disposed axially between the upper ports 116 and the lower ports 117. The sealing seat 153 can receive a sealing object to block fluid communication through the sleeve bore 118. Suitable sealing objects include balls and darts.

In one embodiment, the plug body 142 includes an upper body 151 attached to a lower body 152. The first seat sleeve 111 may be used to connect the upper body 151 to the lower body 152. In this example, a shoulder 146 at the upper end of the first seat sleeve 111 engages the upper body 151, and threads 147 at the lower end are attached to the lower body 152. In another example, threads may be used at both ends, or shoulders may be used at both ends. Other suitable retaining mechanisms, such as a snap ring, may be used. The upper body 151 and the lower body 152 can be made of a drillable material, such plastic, elastomer, aluminum, metal alloy, and combinations thereof. In another embodiment, the plug body 142 is a single body.

The second plug 120 includes a plug body 160 having a bore 165 extending through the plug body 160. A second seat sleeve 121 is disposed in the bore 165 of the second plug 120. The second seat sleeve 121 includes a sleeve bore 128 formed therethrough. The second seat sleeve 121 can be made of a drillable material, such as fiberglass, aluminum, metal alloy, plastic, and combinations thereof. A sealing seat 163 is disposed in the second seat sleeve 121. The sealing seat 163 can receive a sealing object to block fluid communication through the sleeve bore 128.

In one embodiment, the plug body 160 includes an upper body 161 attached to a lower body 162. The second seat sleeve 121 may be used to connect the upper body 161 to the lower body 162. In this example, a shoulder 166 at the upper end of the second seat sleeve 121 engages the upper body 161, and threads 167 at the lower end are attached to the lower body 162. In another example, threads may be used at both ends, or shoulders may be used at both ends. Other suitable retaining mechanisms, such as a snap ring, may be used. The upper body 161 and the lower body 162 can be made of a drillable material, such plastic, elastomer, aluminum, metal alloy, and combinations thereof. In another embodiment, the plug body 160 is a single body.

The first plug 110 and second plug 120 may include one or more fins 144 circumferentially positioned on the exterior surface of the plug body 142, 160. After release, the fins 144 can sealingly contact the inner wall of the casing 10 as the first plug 110 travel down the casing 10. The fins 144 act as a barrier to prevent comingling of fluids from above and below the first plug 110. The fins 144 may clean the wall of the casing 10 as the plug 110 descends in the casing 10.

As shown in FIGS. 1 and 2, the first plug 110 and the second plug 120 are releasably attached to the tubular housing 140. In one embodiment, the plugs 110, 120 are attached to the tubular housing 140 using shearable members 171, 172. For example, shear pins are used to releasably attach the plugs 110, 120 to a wall of the tubular housing 140. In one embodiment, the shearable members attach the upper body 151, 161 of the plugs 110, 120 to the wall of the tubular housing 140. Because the first plug 110 and the second plug 120 are attached to the tubular housing 140, the plugs 110, 120 may be configured to release at the same or different pressure differentials. For example, the shearable members can be selected so that the first plug 110 releases at a lower pressure differential or at a higher pressure differential than the second plug 120. In another example, the shearable members for the first plug 110 and the second plug 120 shear at the same pressure differential. The shearable members 171 retaining the first plug 110 shears at a pressure differential below the pressure differential for breaking the rupture sleeve 150. The shearable members may be made of aluminum or other drillable material. Other suitable shearable members include snap rings and releasable dogs.

In operation, the plug system 100 is disposed in the casing 10 and lowered into the wellbore with the casing 10 using a conveyance string 8. The casing 10 is releasably coupled to the conveyance string 8, and the plug system 100 is attached to the lower end of the conveyance string 8. After reaching the desired location, a first ball 181 is released into the conveyance string 8. Cement is supplied behind the first ball 181. The first ball 181 moves past the second plug 120 and lands in the sealing seat 153 of the first sealing sleeve 111. The first ball 181 blocks fluid communication through the first sealing sleeve 111. Although the upper ports 116 are open for fluid communication, the lower ports 117 are blocked by the rupture sleeve 150.

Figure 3:
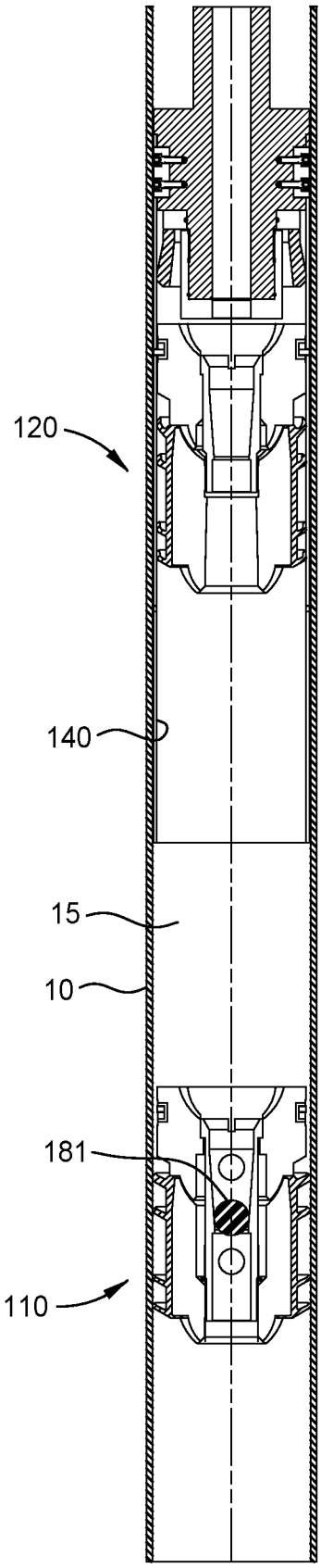
FIG. 3 shows a first plug of the plug assembly of FIG. 2 released from a tubular housing.

The pressure above the first ball 181 is increased sufficiently to shear the pins 171 holding the first plug 110. FIG. 3 shows the first plug 110 released from the tubular housing 140. The first plug 110 has moved out of the tubular housing 140 and is moving through the casing 10. The second plug 120 is still retained in the tubular housing 140.

The first plug 110 continues to move through the casing 10 until it lands on the float assembly 20. The pressure above the first plug 110 is increased until the pressure is sufficient to break the rupture sleeve 150, thereby opening the lower ports 117 for fluid communication. The cement can bypass the first ball 181 by flowing through the upper ports 116 to enter the annular area 113, and flowing through the lower ports 117 to exit the annular area 113. After returning to the bore 145, the cement flows through the valve 32 and out of the casing 10 via the ports 34A, 34B. The cement flows up the annulus between the casing 10 and the wellbore.

The second plug 120 is released behind the cement to separate the cement from the push fluid, which may be a drilling fluid. A second ball 182 is released into the conveyance string 8. The second ball 182 has an outer diameter that is larger than the first ball 181. The second ball 182 lands in the sealing seat 163 of the second sealing sleeve 121 of the second plug 120. The second ball 182 blocks fluid communication through the second sealing sleeve 121.

Figure 4:
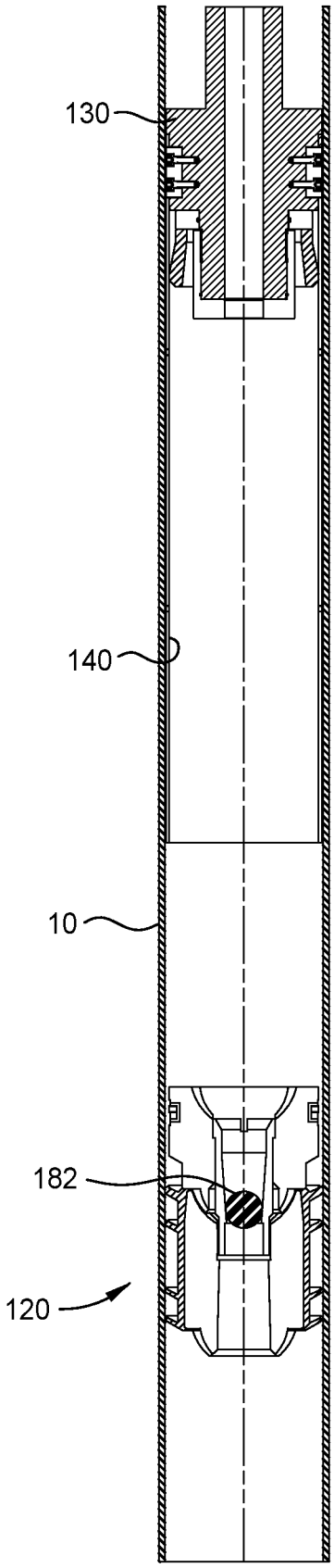
FIG. 4 shows a second plug of the plug assembly of FIG. 2 released from a tubular housing.

The pressure above the second ball 182 is increased sufficiently to shear the pins 172 holding the second plug 120. FIG. 4 shows the second plug 120 released from the tubular housing 140. The second plug 120 has moved out of the tubular housing 140 and is moving through the casing 10 toward the first plug 110. The second plug 120 forces cement between the first plug 110 and the second plug 120 to flow out of the casing 10. The second plug 120 continues to move through the casing 10 until it lands on the first plug 110. The cement in the annulus is allowed to cure. The tubular housing 140 can be retrieved by retrieving the conveyance string 8.

Figure 5:
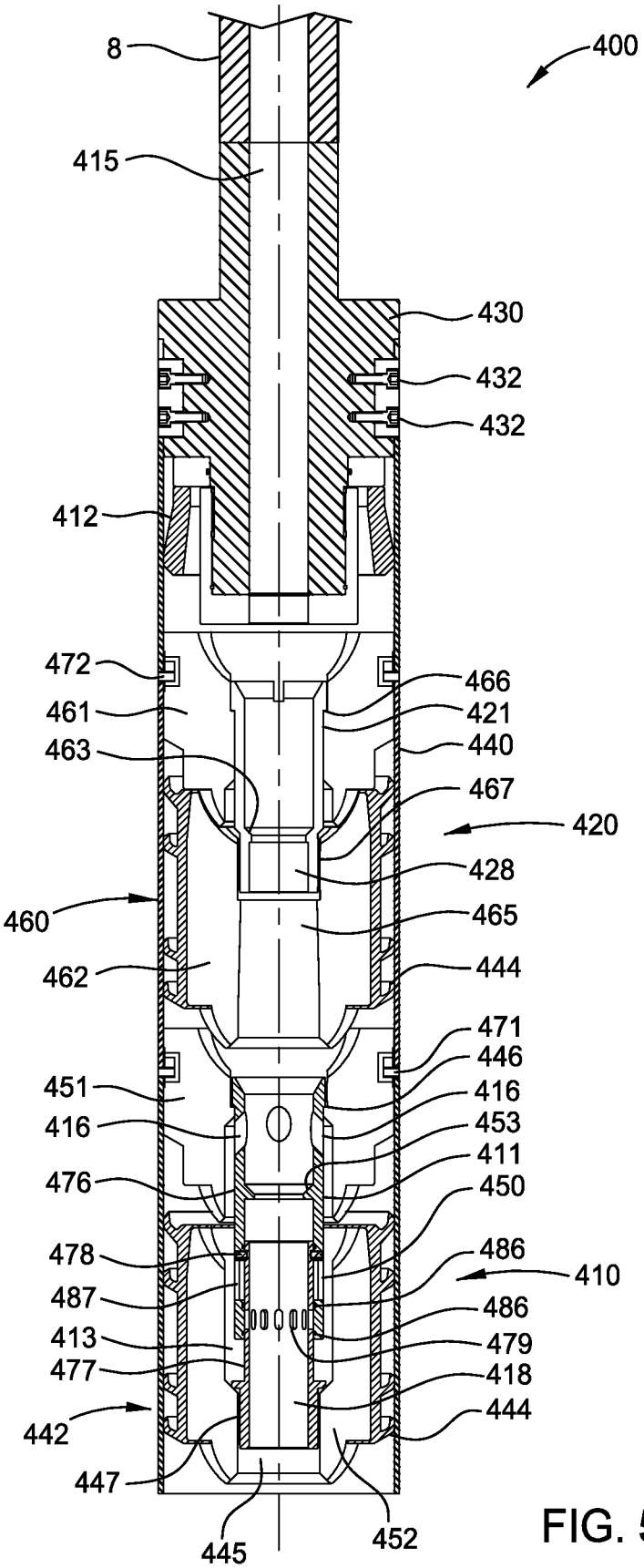
FIG. 5 shows another embodiment of a plug assembly.

FIG. 5 illustrates another embodiment of a plug assembly 400 suitable for use with the system of FIG. 1. The plug assembly 400 includes a connector 430, a tubular housing 440, a first plug 410, and a second plug 420. An upper end of the connector 430 may be attached to a conveyance string 8 such as a drill pipe string. The tubular housing 440 is attached to the connector 430. A portion of the connector 430 is at least partially disposed in the tubular housing 440. The tubular housing 440 may be attached using a plurality of screws 432. The tubular housing 440 can be made of steel, metal alloy, or other suitable material. The tubular housing 440 may be between 3 feet and 40 feet in length or between 3 feet and 20 feet in length. The connector 430 includes a bore 415 in fluid communication with the conveyance string 8 and the bore of the tubular housing 440. A sealing member 412 such as a cup seal is attached to the connector 430 and used to prevent fluid communication in an annular area between the connector 430 and the housing 440 and to seal off communication of plug launch pressure to the exterior of the housing 440 via holes (not shown) located above the cup seal. In one embodiment, the tubular housing 440 is made of steel, aluminum, or other suitable metal or metal alloy. In another embodiment, the tubular housing 440 is retrievable to surface and re-used.

The first plug 410 and the second plug 420 are disposed in the housing 440 and releasably attached to the housing 440. The first plug 410 is disposed below the second plug 420, and the second plug 420 is disposed below the connector 430. In this embodiment, neither plug 410, 420 is attached to the connector 430. In this arrangement, the first plug 410 may be referred to as the bottom plug and the second plug 420 may be referred to as the top plug.

In one embodiment, the first plug 410 includes a plug body 442 having a bore 445 extending through the plug body 442. A first seat sleeve 411 is disposed in the bore 445 of the first plug 410. The first seat sleeve 411 includes a sleeve bore 418 formed therethrough. The first seat sleeve 411 can be made of a drillable material, such as fiberglass, aluminum, metal alloy, plastic, and combinations thereof. An annular area 413 is formed between the first seat sleeve 411 and the wall of the bore 445.

The first seat sleeve 411 includes an upper sleeve 476 releasably coupled to a lower sleeve 477. In this example, the upper end of the lower sleeve 477 is partially disposed in the lower end of the upper sleeve 476. In one embodiment, the upper sleeve 476 is coupled to the lower sleeve 477 using one or more shearable members 478 such as a shear pin. The upper sleeve 476 includes one or more upper ports 416 for fluid communication between the sleeve bore 418 and the annular area 413. For example, one, two, or four ports 416 can be circumferentially spaced around the upper sleeve 476. The lower sleeve 477 includes one or more lower ports 479 for selective fluid communication between the sleeve bore 418 and the annular area 413. For example, one, two, four, six, eight, or twelve ports 479 can be circumferentially spaced around the lower sleeve 477. The lower ports 479 are initially blocked from fluid communication by the lower end of the upper sleeve 476. Two sealing members 486, such as o-rings, are disposed between the upper sleeve 476 and the lower sleeve 477. The sealing members 486 straddle the lower ports 479 to prevent communication between the annular area 413 and sleeve bore 418. In one example, a plurality of cement ports 487 are formed in the upper sleeve 476 and located above the two sealing members 486. The cement ports 487 allow selective fluid communication between the sleeve bore 418 and the annular area 413. A sealing seat 453 is formed in the upper sleeve 476 and disposed axially between the upper ports 416 and the lower ports 479. The sealing seat 453 can receive a sealing object to block fluid communication through the sleeve bore 418. Suitable sealing objects include balls and darts.

In one embodiment, the plug body 442 includes an upper body 451 coupled to a lower body 452. The first seat sleeve 411 may be used to connect the upper body 451 to the lower body 452. In this example, a shoulder 446 at the upper end of the first seat sleeve 411 engages the upper body, and threads 447 at the lower end are attached to the lower body 452. In another example, threads may be used at both ends, or shoulders may be used at both ends. Other suitable retaining mechanisms, such as a snap ring, may be used. The upper body 451 and the lower body 452 can be made of a drillable material, such plastic, elastomer, aluminum, metal alloy, and combinations thereof. In another embodiment, the plug body 442 is a single body.

The second plug 420 includes a plug body 460 having a bore 465 extending through the plug body 460. A second seat sleeve 421 is disposed in the bore 465 of the second plug 420. The second seat sleeve 421 includes a sleeve bore 428 formed therethrough. The second seat sleeve 421 can be made of a drillable material, such as fiberglass, aluminum, metal alloy, plastic, and combinations thereof. A sealing seat 463 is disposed in the second seat sleeve 421. The sealing seat 463 can receive a sealing object to block fluid communication through the sleeve bore 428.

In one embodiment, the plug body 460 includes an upper body 461 attached to a lower body 462. The second seat sleeve 421 may be used to connect the upper body 461 to the lower body 462. In this example, a shoulder 466 at the upper end of the second seat sleeve 421 engages the upper body 461, and threads 467 at the lower end are attached to the lower body 462. In another example, threads may be used at both ends, or shoulders may be used at both ends. Other suitable retaining mechanisms, such as a snap ring, may be used. The upper body 461 and the lower body 462 can be made of a drillable material, such plastic, elastomer, aluminum, metal alloy, and combinations thereof. In another embodiment, the plug body 460 is a single body.

The first plug 410 and second plug 420 may include one or more fins 444 circumferentially positioned on the exterior surface of the plug body 442, 460. After release, the fins 444 can sealingly contact the inner wall of the casing 10 as the first plug 410 travel down the casing 10. The fins 444 act as a barrier to prevent comingling of fluids from above and below the first plug 410. The fins 444 may clean the wall of the casing 10 as the plug 410 descends in the casing 10.

The first plug 410 and the second plug 420 are releasably attached to the tubular housing 440. In one embodiment, the plugs 410, 420 are attached to the tubular housing 440 using shearable members 471, 472. For example, shear pins are used to releasably attach the plugs 410, 420 to a wall of the tubular housing 440. Because the first plug 410 and the second plug 420 are attached to the tubular housing 440, the plugs 410, 420 may be configured to release at the same or different pressure differentials. For example, the shearable members can be selected so that the first plug 410 releases at a lower pressure differential or at a higher pressure differential than the second plug 420. In another example, the shearable members for the first plug 410 and the second plug 420 shear at the same pressure differential. The shearable members may be made of aluminum or other drillable material. Other suitable shearable members include snap rings and releasable dogs.

Figure 6:
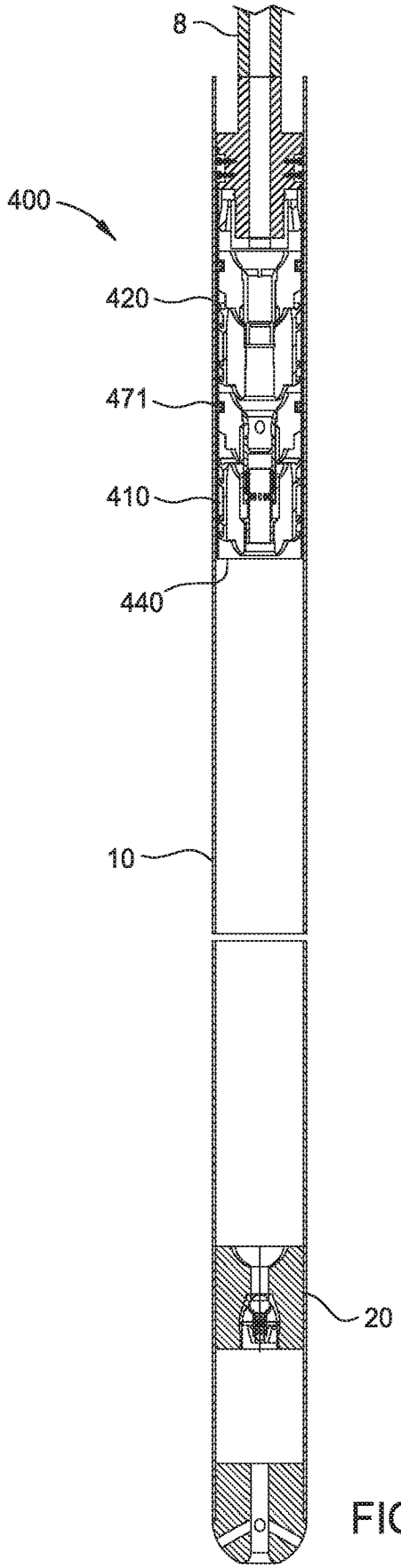
FIGS. 6-9 show an operation sequence using the plug assembly of FIG. 5.

In operation, referring to FIG. 6, the plug system 400 is disposed in the casing 10 and lowered into the wellbore with the casing 10 using a conveyance string 8. The casing 10 is releasably coupled to the conveyance string 8, and the plug system 400 is attached to the lower end of the conveyance string 8. After reaching the desired location, a first ball 481 is released into the conveyance string 8. Cement is supplied behind the first ball 481. The first ball 481 moves past the second plug 420 and lands in the first plug 410. In this embodiment, the first ball 481 lands in the sealing seat 453 of the first sealing sleeve 411. The first ball 481 blocks fluid communication through the first sealing sleeve 411. The sealing members 486 prevent fluid in the annular area 413 from entering the lower ports 479.

Figure 7:
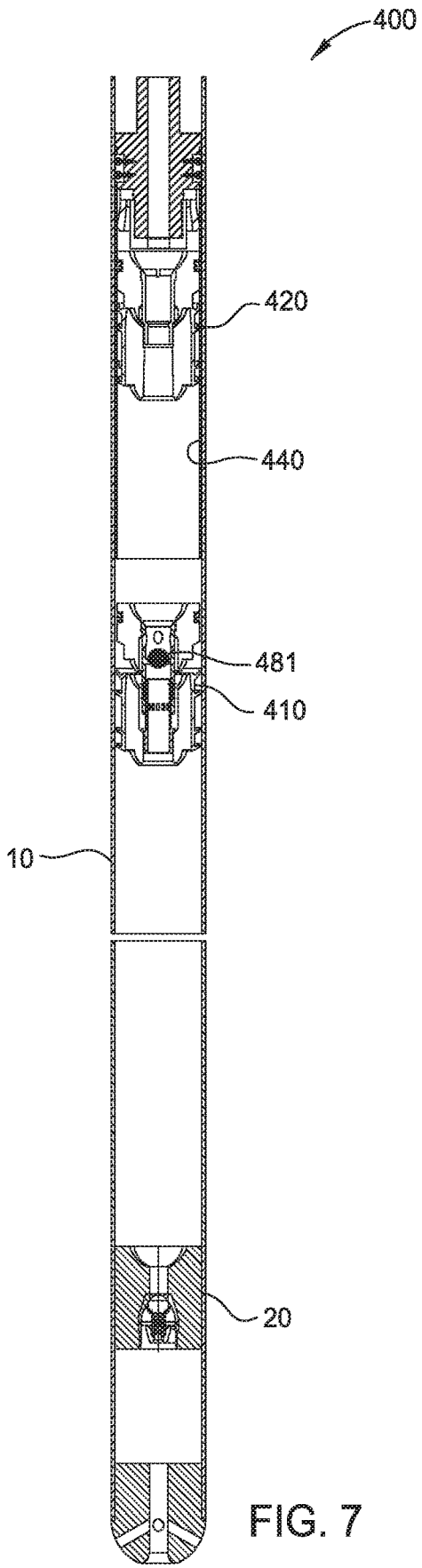

The pressure above the first ball 181 is increased sufficiently to shear the pins 471 holding the first plug 410. As a result, the first plug 410 is released from the housing 440 and moves down the casing 10 under the pressure of the cement, as shown in FIG. 7. In this view, the first plug 410 has moved below the housing 440.

Figure 8:
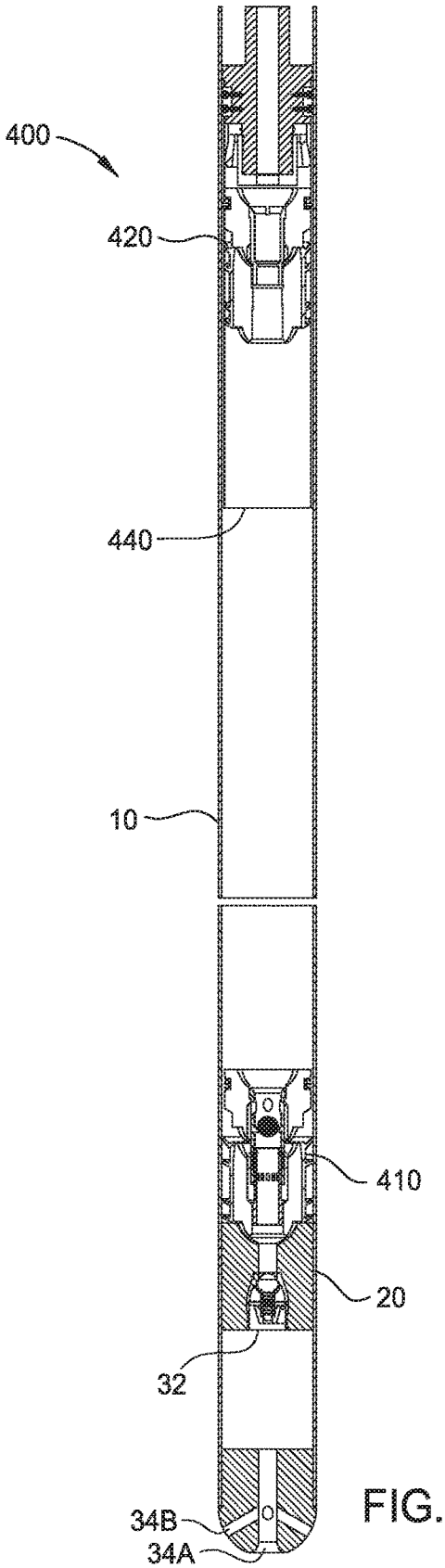

Referring to FIG. 8, the first plug 410 continues to move through the casing 10 until it lands on the float assembly 20. The pressure above the first plug 410 is increased until the pressure is sufficient to break the shear pins 478, thereby allowing the upper sleeve 476 to move downward relative to the lower sleeve 477. Because the upper body 451 is coupled to the upper sleeve 476, the upper body 451 also moves downward relative to the lower body 452. Downward movement of the upper sleeve 476 moves the o-rings 486 away from the lower ports 479 and aligns the cement ports 487 with the lower ports 479 for fluid communication. The cement can bypass the first ball 181 by flowing through the upper ports 416 to enter the annular area 413, and flowing through the lower ports 417 to exit the annular area 413. After returning to the bore 445, the cement flows through the valve 32 and out of the casing 10 via the ports 34A, 34B. The cement flows up the annulus between the casing 10 and the wellbore.

Figure 9:
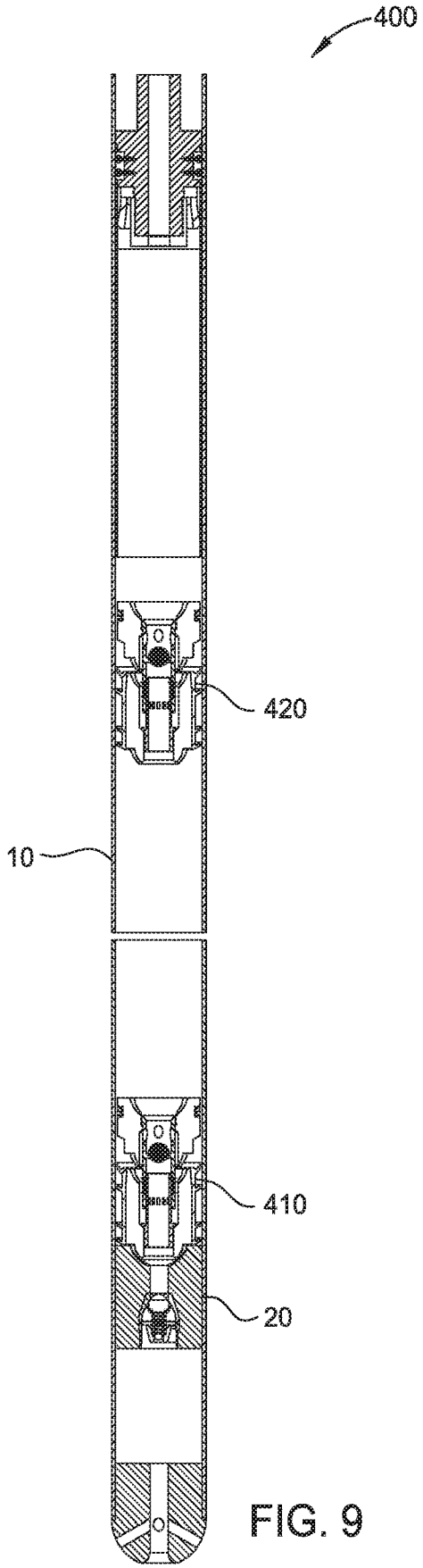

Referring to FIG. 9, the second plug 420 is released behind the cement to separate the cement from the push fluid, which may be a drilling fluid. A second ball 482 is released into the conveyance string 8. The second ball 482 has an outer diameter that is larger than the first ball 481. The second ball 482 lands in the sealing seat 463 of the second sealing sleeve 421 of the second plug 420. The second ball 182 blocks fluid communication through the second sealing sleeve 421.

The pressure above the second ball 182 is increased sufficiently to shear the pins 472 holding the second plug 420. After release from the housing 440, the second plug 420 forces cement between the first plug 410 and the second plug 420 to flow out of the casing 10. The second plug 420 continues to move through the casing 10 until it lands on the first plug 410. The cement in the annulus is allowed to cure. The tubular housing 440 can be retrieved by retrieving the conveyance string 8.

In one embodiment, a system for cementing a tubular within a wellbore includes a connector; a tubular housing attached to the connector and disposed in the tubular; and a plug disposed in the tubular housing and releasably attached to the tubular housing.

In one or more of the embodiments described herein, the plug is a first plug and the system further comprises a second plug disposed in the tubular housing and releasably attached to the tubular housing.

In one or more of the embodiments described herein, a pressure differential for releasing the second plug is same or lower than a pressure differential for releasing the first plug.

In one or more of the embodiments described herein, the first plug and the second plug are releasably attached to the tubular housing using a shear mechanism.

In one or more of the embodiments described herein, the first plug includes a first seat, and the second plug includes a second seat, and wherein the first seat is configured to receive a sealing object having a larger diameter than a sealing object received in the second seat.

In one or more of the embodiments described herein, the plug includes a sealing sleeve disposed in a bore of the plug, wherein an annular area is formed between the sealing sleeve and a wall of the bore.

In one or more of the embodiments described herein, the sealing sleeve includes an upper port and a lower port in fluid communication with the annular area; and a sealing seat formed in a bore of the sealing sleeve between the upper port and the lower port.

In one or more of the embodiments described herein, the system includes a rupture sleeve selectively blocking fluid communication through the lower port.

In one or more of the embodiments described herein, the sealing sleeve includes an upper sleeve releasably coupled to a lower sleeve.

In one or more of the embodiments described herein, the upper sleeve includes an upper port and a cement port in fluid communication with the annular area; the lower sleeve includes a lower port in selective fluid communication with the cement port; and a sealing seat formed in a bore of the sealing sleeve between the upper port and the lower port.

In one or more of the embodiments described herein, the upper sleeve is movable from a first position blocking fluid communication through the lower port and a second position aligning the cement port with the lower port.

A method of cementing a tubular in a wellbore includes coupling a plug system to the tubular, wherein the plug system includes a connector coupled to the tubular; a tubular housing attached to the connector and at least partially disposed in the tubular; and a first plug disposed in the tubular housing and releasably attached to the tubular housing. The method also includes releasing the first plug from the tubular housing; opening a port in the first plug; and flowing cement through the port.

In one or more of the embodiments described herein, the plug system includes a second plug disposed in the tubular housing and releasably attached to the tubular housing.

In one or more of the embodiments described herein, the method includes releasing the second plug from the tubular housing after releasing the first plug.

In one or more of the embodiments described herein, a pressure differential for releasing the second plug is same or lower than a pressure differential for releasing the first plug.

In one or more of the embodiments described herein, releasing the first plug comprises landing a sealing object in the first plug.

In one or more of the embodiments described herein, opening a port comprises applying pressure to break a rupturable member blocking the port.

In one or more of the embodiments described herein, opening a port further comprises flowing cement around the sealing object to break the rupturable member.

In one or more of the embodiments described herein, the first plug includes an upper body and a lower body, and the upper body is attached to the tubular housing.

In one or more of the embodiments described herein, the method includes coupling the upper body to the lower body using a seat sleeve.

In one or more of the embodiments described herein, the seat sleeve includes an upper sleeve releasably attached to a lower sleeve.

While the foregoing is directed to embodiments of the present disclosure, other and further embodiments of the disclosure may be devised without departing from the basic scope thereof, and the scope thereof is determined by the claims that follow.

The invention claimed is:

1. A method of cementing a tubular in a wellbore, comprising:

coupling a plug system to the tubular, the plug system including:

a connector coupled to the tubular;

a tubular housing attached to the connector and at least partially disposed in the tubular; and a first plug disposed in the tubular housing and releasably attached to the tubular housing;

after the tubular housing is placed within the wellbore, releasing the first plug from the tubular housing by landing a sealing object in the first plug;

opening a port in the first plug; and flowing cement through the port, out of the tubular, and into an annulus between the tubular and the wellbore.

2. The method of claim 1, wherein the plug system includes a second plug disposed in the tubular housing and releasably attached to the tubular housing.

3. The method of claim 2, further comprising releasing the second plug from the tubular housing after releasing the first plug.

4. The method of claim 1, wherein opening a port comprises applying pressure to break a rupturable member blocking the port.

5. The method of claim 4, wherein opening a port further comprises flowing cement around the sealing object to break the rupturable member.

6. The method of claim 1, wherein the first plug includes an upper body and a lower body, and the upper body is attached to the tubular housing.

7. The method of claim 6, further comprising coupling the upper body to the lower body using a seat sleeve.

8. The method of claim 7, wherein the seat sleeve includes an upper sleeve releasably attached to a lower sleeve.

9. The method of claim 3, wherein a pressure differential for releasing the second plug is the same or lower than a pressure differential for releasing the first plug.

10. The method of claim 9, wherein opening a port comprises applying pressure to break a rupturable member blocking the port.

11. The method of claim 10, wherein opening a port further comprises flowing cement around the sealing object to break the rupturable member.

12. The method of claim 9, wherein the first plug includes an upper body and a lower body, and the upper body is attached to the tubular housing.

13. The method of claim 12, further comprising coupling the upper body to the lower body using a seat sleeve.

14. The method of claim 13, wherein the seat sleeve includes an upper sleeve releasably attached to a lower sleeve.

15. The method of claim 1, further comprising, prior to releasing the plug, flowing fluid through a bore in the first plug.

16. The method of claim 1, wherein the first plug is releasably attached to a portion of the tubular housing that overlaps with the tubular.

17. The method of claim 16, further comprising a second plug disposed inside of and releasably attached to the portion of the tubular housing that overlaps with the tubular.

18. The method of claim 16, wherein the connector is attached to a conveyance string, and the method further comprises lowering the plug system and the tubular into the wellbore using the conveyance string.

19. The method of claim 18, wherein the sealing object is released into the conveyance string before landing in the first plug.

20. The method of claim 1, wherein releasing the first plug from the tubular housing further comprises:

creating a differential pressure across the first plug by applying a pressure to the sealing object after landing the sealing object in the first plug;

preventing the pressure from communicating into an annular area between the tubular housing and the tubular by a seal member located within the tubular housing above the first plug; and breaking an attachment between the first plug and the tubular housing by a force resulting from the differential pressure.

* * * * *